US006174074B1

(12) United States Patent
Lahijani

(10) Patent No.: US 6,174,074 B1
(45) Date of Patent: Jan. 16, 2001

(54) BALLAST HOUSING FOR DISPLAY LIGHTING ASSEMBLIES

(76) Inventor: Mohammad Lahijani, P.O. Box 144979, Coral Gables, FL (US) 33114-4929

( * ) Notice: Under 35 U.S.C. 154(b), the term of this patent shall be extended for 0 days.

(21) Appl. No.: 09/332,865

(22) Filed: Jun. 15, 1999

(51) Int. Cl.[7] ..... F21S 8/02; F21V 29/00
(52) U.S. Cl. ..... 362/264; 362/265; 362/294
(58) Field of Search ..... 362/263, 264, 362/265, 294, 373, 260

(56) References Cited

U.S. PATENT DOCUMENTS 4,054,790 * 10/1977 Slaughter ..... 362/264
5,136,493 * 8/1992 Straus et al. ..... 362/373
5,548,497 * 8/1996 Cho ..... 362/260

* cited by examiner

*Primary Examiner*—Thomas M. Sember
(74) *Attorney, Agent, or Firm*—J. Sanchelima

(57) ABSTRACT

A housing for lighting assemblies used to enclosed a ballast. Two opposite walls include each a pair of longitudinally extending pairs of ribs that slidably receive the ends of a plate member. The walls and the plate member are made out of a heat conducting material, such as aluminum. One of the plates is mounted urging said ballast against one of the walls for coplanar abutment and maximum heat transfer from the ballast to the walls. Another plate is mounted between the ballast and one of the end walls to avoid movement of the ballast, specially during transportation. Elongated longitudinally extending heat dissipating ribs are defined in the outer surfaces of the housing walls.

5 Claims, 1 Drawing Sheet

BALLAST HOUSING FOR DISPLAY LIGHTING ASSEMBLIES

BACKGROUND OF THE INVENTION

1. Field of the Invention

The present invention relates to a ballast housing for display lighting assemblies.

2. Description of the Related Art

Many lighting fixtures exist today that include a ballast to drive high intensity discharge lamps, such as metal halide lamps and others. These ballasts are typically not attractive and are enclosed within a housing. The ballast, however, generates considerable heat which needs to be dissipated to ensure a longer life for these electronic components.

One of these applications involve the use of high intensity lamp fixtures in jewelry displays. Intense lights are desirable to enhance the qualities of the jewelry pieces on display. However, the heat dissipated not infrequently is transmitted to the display surroundings bothering customers when they lean on areas exposed to the heat generated by the ballast and sometimes even get burned.

The present invention resolves this problem by providing a housing that facilitates the heat transfer from the ballast to the housing that includes heat sinks on its external surface. Additionally, the configuration of the housing promotes heat transfer to the surrounding atmosphere by convection. Finally, the present invention permits a user to direct most of the heat transfer to one of the two walls in a housing depending on the particular conditions, including the availability of air conditioning outlets.

SUMMARY OF THE INVENTION

It is one of the main objects of the present invention to provide a housing with an internal adjusting mechanism to maximize heat transfer from the internal ballast to the housing internal surfaces.

It is another objects of the present invention to provide a housing for a ballast used in lighting fixtures that permits a user to select the optimum position for transferring the heat to the exterior.

It is another object of this invention to provide such housing that is compatible with most existing ballasts.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
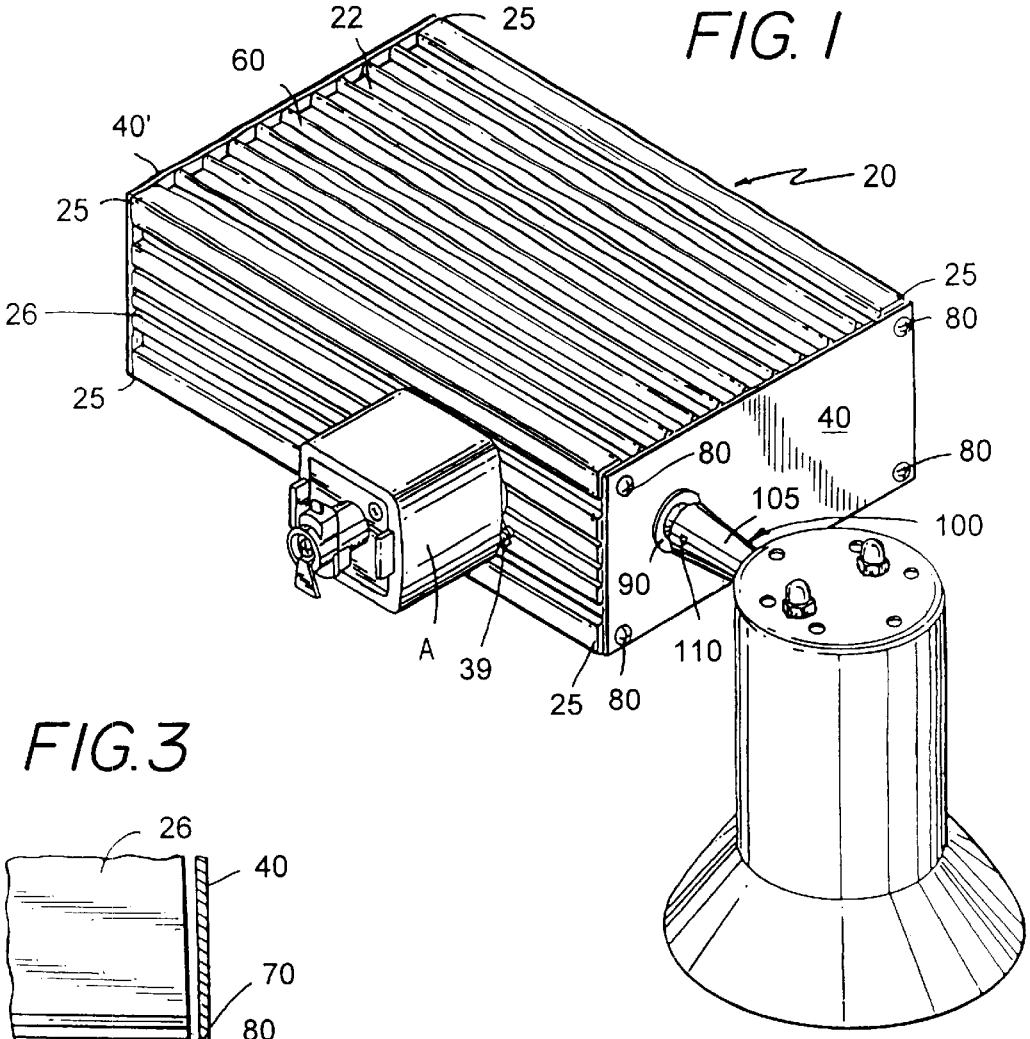
FIG. 1 represents an isometric view of one of the preferred embodiments for the present invention.
Figure 3:
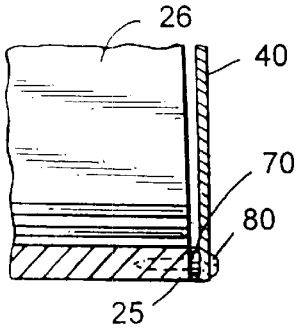
FIG. 3 illustrates partial detail view of one of the corners of the housing where cover is partially shown with a fastener and washer defining a space between the cover and the edge of the walls.

Referring now to the drawings, where the present invention is generally referred to with numeral 10, it can be observed that it basically includes housing 20 defining a space therein with a rectangular cross-section and front and back covers 40 and 40'.

Opposite walls 22 and 24 are kept at a spaced apart and parallel relationship with respect to each others. Walls 22 and 24 have each a flat internal surface that cooperate for contiguous abutment with ballast B for maximum surface to surface contact and heat transfer.

End walls 26 and 28 are also kept at a spaced apart and parallel relationship with respect each other. End walls 26 and 28 are flat, in the preferred embodiment, and include an internal bay to provide relief for the wires W coming from track adapter A.

Housing 20, including walls 22; 24; 26 and 28, are made out of a heat conducting material. Extruded aluminum is one of the preferred materials because of its low weight and adaptability.

Figure 2:
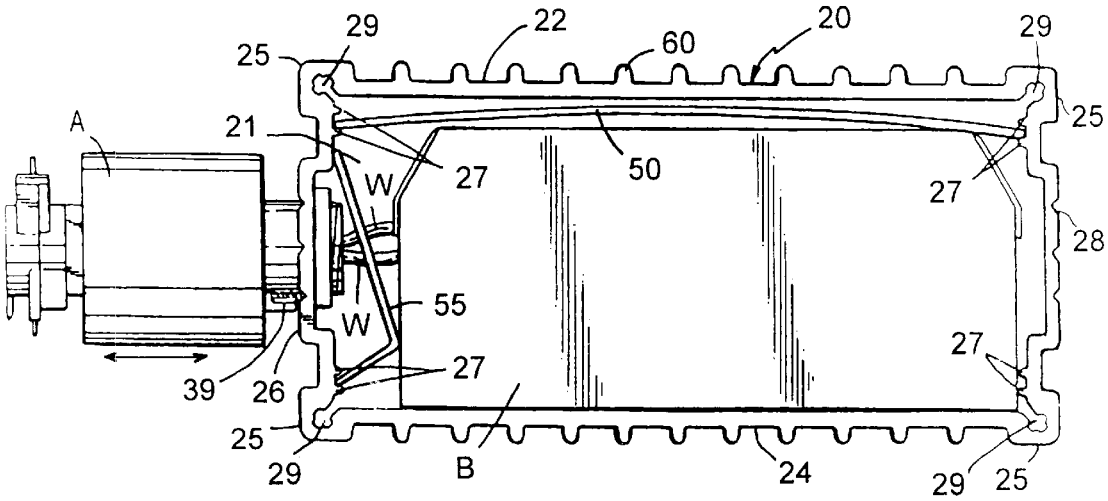
FIG. 2 shows is a front elevational view of the extruded aluminum or plastic ballast housing.

End walls 26 and 28 include each two pairs of guiding ribs 27 that receive the ends resilient plate 50 that slide between the ribs of each pair. Plate 50 has a cooperative dimension to have its ends slide between the ribs of guiding ribs 27 forming a bow that urges ballast B against the opposite wall 22, or 24, to bring ballast B in abutting relationship with these walls. Also, guiding ribs 27 prevent the crushing of cables or wire W during transportation since they stop ballast B. Wire bay 21 also provides space for wires W. Another plate 55 is mounted between end walls 26 or 28 and ballast B, as shown in FIG. 2. In this manner, movement of ballast B is prevented such as when in transportation.

Elongated exterior ribs 60 facilitate the radiation or dissipation of heat to the surrounding atmosphere.

Covers 40 and 40' are mounted on washers 70 that in turn are adjacent to the corners 25 of housing 20. The resulting separation permits the hot air to go through by connection and fresh (colder) air replaces the displaced air. The corners 25 include an extruded longitudinal slot 29 that cooperates to receive a fastener member 80 thereby avoiding secondary productions operations to make openings.

Track adapter A is mounted to either wall 26 or 28 and includes an internal port that allows the wires to go through. Stop pin 39 is mounted on the wall where adapter A is mounted to prevent a user from rotating adapter A more than 360° since this tends to damage the wires by twisting them.

Lamp holder assembly 100 is mounted to housing 20 through swivel assembly 90. Swivel assembly 90 permits a user to rotate lamp holder 100 circumferentially up to 360°. There are stop members 110 between neck 105 and swivel assembly 90 to prevent rotation beyond 360° that may damage wires W.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A housing for ballasts with at least one flat surface, comprising:

A) first and second walls kept at a parallel and spaced apart relationship with respect to each other and said first wall including an aperture for passing wires therethrough, third and fourth walls also kept at a spaced apart and parallel relationship with respect to each other, said first, second, third and fourth walls having each internal and external surfaces and being connected to each other defining a rectangular cross-section; each of said walls having two opposing free ends defining common edges and two end openings and said first; second walls having interior surfaces including longitudinally extending pairs of ribs that extend substantially parallel and opposite to each other;

B) a resilient heat conducting first plate having first and second ends having a cooperative longitudinal dimension to permit said first and second ends to slide between said opposite pair of ribs so that said plate comes in contact with a flat surface of a ballast enclosed within said housing urging said ballast against said third wall thereby maximizing the heat transfer from said ballast to said housing;

C) two covers with cooperative dimensions to close said end openings; and

D) a lamp holder assembly including a second assembly mounted to one of said covers.

2. The housing set forth in claim 1 wherein each of said first, second, third and fourth walls include longitudinally extending heat dissipating ribs on their respective outer surfaces.

3. The housing set forth in claim 2 further including:

E) a track adapter assembly mounted to said first wall and further including a connecting port for passing cables through.

4. The housing set forth in claim 3 further including spacer means for keeping said covers separated a predetermined distance from the ends of the walls to which they are mounted thereby permitting the exit and entry of air to said housing.

5. The housing set in claim 4 further including:

F) a resilient heat conducting second plate removably mounted between said second wall and the ballast housed within said housing so that a space is defined between said first wall and said ballast, and said second plate also conducts heat away from the ballast.

* * * * *